US005296903A

United States Patent [19]

Suzuki et al.

[11] Patent Number: 5,296,903

[45] Date of Patent: Mar. 22, 1994

[54] IMAGE FORMING APPARATUS HAVING CONTROL BASED ON DETECTED TONER CHARGE AND TRANSFER EFFICIENCY

[75] Inventors: Akio Suzuki, Yokohama; Hisashi Fukushima, Kawasaki; Haruhiko Moriguchi, Yokohama; Yasushi Miura, Kawasaki; Nobuatsu Sasanuma, Yamato, all of Japan

[73] Assignee: Canon Kabushiki Kaisha, Tokyo, Japan

[21] Appl. No.: 961,387

[22] Filed: Oct. 15, 1992

[30] Foreign Application Priority Data

Oct. 18, 1991 [JP] Japan ..... 3-298120

[51] Int. Cl.[5] ..... G03G 15/14

[52] U.S. Cl. ..... 355/271; 355/203; 355/208; 355/274

[58] Field of Search ..... 355/203, 208, 271, 273, 355/274–276, 246, 326–327

[56] References Cited

U.S. PATENT DOCUMENTS 4,772,918 9/1988 Karasawa et al. ..... 355/274

FOREIGN PATENT DOCUMENTS 0087739 8/1978 Japan ..... 355/203
0111570 7/1982 Japan ..... 355/275
0015272 1/1984 Japan ..... 355/208
0065866 4/1984 Japan ..... 355/208
0055675 3/1986 Japan ..... 355/273
0279367 12/1987 Japan ..... 355/208
0198079 8/1991 Japan ..... 355/275

*Primary Examiner*—A. T. Grimley
*Assistant Examiner*—William J. Royer
*Attorney, Agent, or Firm*—Fitzpatrick, Cella, Harper & Scinto

[57] ABSTRACT

An image forming apparatus has an image bearing member; a toner image forming device for forming a toner image on the image bearing member; a transfer charger for transferring the toner image from the image bearing member onto a transfer material; a first detector for detecting toner charge amount before image transfer onto the transfer material; a second detector for detecting the efficiency of the image transfer; and a controller for controlling a condition of image transfer operation in accordance with outputs of the first and second detector.

21 Claims, 5 Drawing Sheets

IMAGE FORMING APPARATUS HAVING CONTROL BASED ON DETECTED TONER CHARGE AND TRANSFER EFFICIENCY

FIELD OF THE INVENTION AND RELATED ART

The present invention relates to an image forming apparatus such as an electrophotographic apparatus or an electrostatic recording apparatus, and more particularly to an image forming apparatus in which an image transfer condition is controllable.

In a known image forming apparatus, a toner image is formed on an image bearing member in the form of a photosensitive member, and the toner image is electrostatically transferred onto a transfer material such as sheet. In order to provide a satisfactory image in such an image forming apparatus, it is desirable to increase image transfer efficiency. Particularly in the case of color image formation, the image transfer process is significantly influential to the image quality. The transfer efficiency is dependent on an image transfer electric field, and in order to increase the transfer efficiency, it is known that control of the transfer electric field control is effective. However, even if the transfer electric field is controlled in order to optimize the transfer efficiency, the transfer efficiency varies depending on the toner charge amount before the image transfer, and the optimum control of the transfer condition has been difficult.

SUMMARY OF THE INVENTION

Accordingly, it is a principal object of the present invention to provide an image forming apparatus in which the transfer condition with which the toner image is transferred from the image bearing member to a transfer material, is optimized.

It is another object of the present invention to provide an image forming apparatus in which the toner charge amount before the image transfer can be controlled.

It is a further object of the present invention to provide an image forming apparatus in which the transfer efficiency and the toner charge amount before the image transfer are detected.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
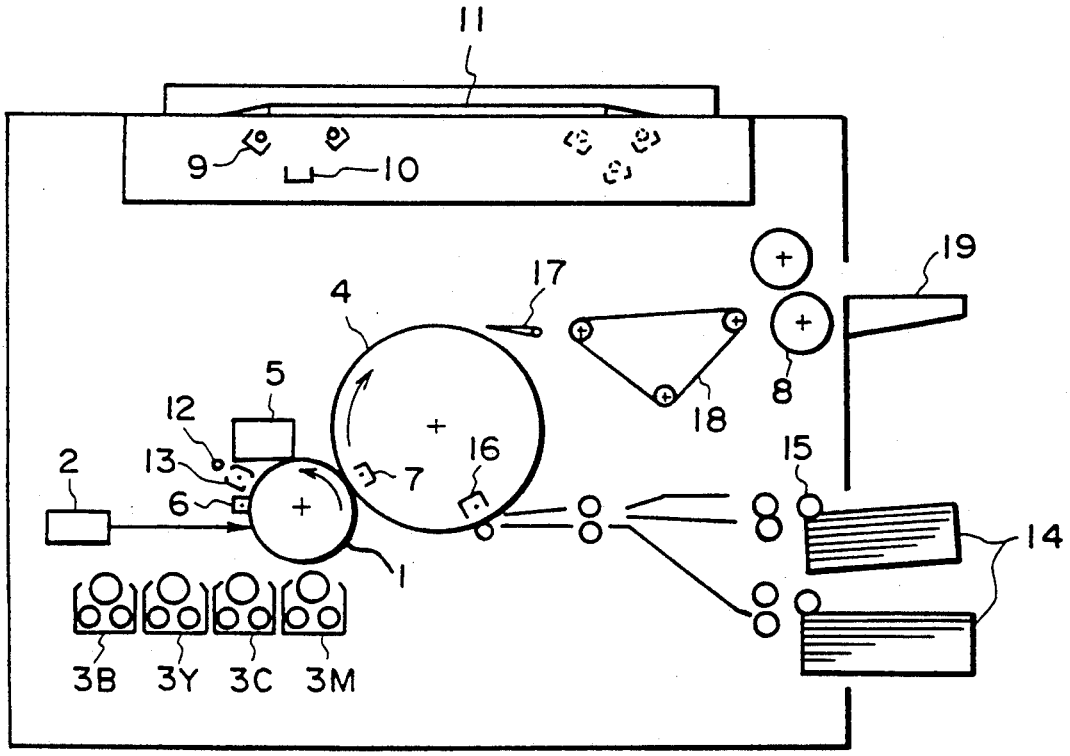
FIG. 4 is a schematic diagram of an image forming apparatus according to a further embodiment of the present invention.

Referring to FIG. 4, there is shown a color image forming apparatus according to an embodiment of the present invention. In this image forming apparatus, a photoreceptor element 10 travels with an illumination lamp 9 to read an original 11, and converts the image thereof into R, G and B electric signals. The electric signals for three colors are converged to image signals of magenta, cyan, yellow and black image signals by an unshown image processor. A surface of a photosensitive drum is cleaned by a cleaner 5, and the influence of a previous latent image has been removed by an exposure lamp 12 and a pre-discharger 13. The photosensitive drum 1 comprises a photosensitive layer such as an organic photoconductor layer and a grounded conductive base for supporting the photosensitive layer.

The photosensitive drum 1 is uniformly charged by a primary charger 6 and is exposed to light corresponding to a magenta image signal emitted from a light source 2 such as a laser scanner or the like, so that an electrostatic latent image of a magenta component is formed on the photosensitive drum 1. The latent image is developed with a developing device 3M for the magenta color, so that a magenta toner image is formed on the photosensitive drum 1.

On the other hand,, transfer sheets 14, accommodated in a cassette, are fed out one-by-one by a sheet feeding roller 15 to a transfer drum 4. The transfer sheet 14 is electrostatically attracted on the transfer drum 4 by an attraction charger 16, and is fed by rotation of the transfer drum 4 to an image transfer position where the transfer sheet is faced to the photosensitive drum 1. In the transfer position, the magenta toner image is transferred from the photosensitive drum 1 onto the transfer sheet 14 continuously by a transfer charger 7.

Similarly, a cyan toner image, a yellow toner image and a black toner image are sequentially formed on the photosensitive drum 1, and they are sequentially transferred and superposed on the transfer sheet 14. Thus, on the transfer sheet 14, four color toner images are overlaid, and therefore, a full color image is provided. When the cyan, yellow and black toner images are formed on the photosensitive drum 1, the cyan, yellow and black developing devices 3C, 3Y and 3B, are slid in a horizontal direction to be presented at a developing position where it is faced to the photosensitive drum 1 to effect the respective developing operations.

When the four color toner image transfer operations are completed, the transfer sheet 14 is separated from the transfer drum 4 by separation pawls 17, and is conveyed to an image fixing device 8 on a conveyer belt 18. In the fixing device, the four color toner images are mixed and are fixed. Thereafter, the transfer sheet 14 is discharged onto a sheet discharge tray 19.

In such a color image forming apparatus, the image quality is significantly influenced by the image transfer process. The operation in the image transfer process is influenced significantly by the amount of electric charge of the toner before the image transfer and by the transfer electric field.

Figure 5:
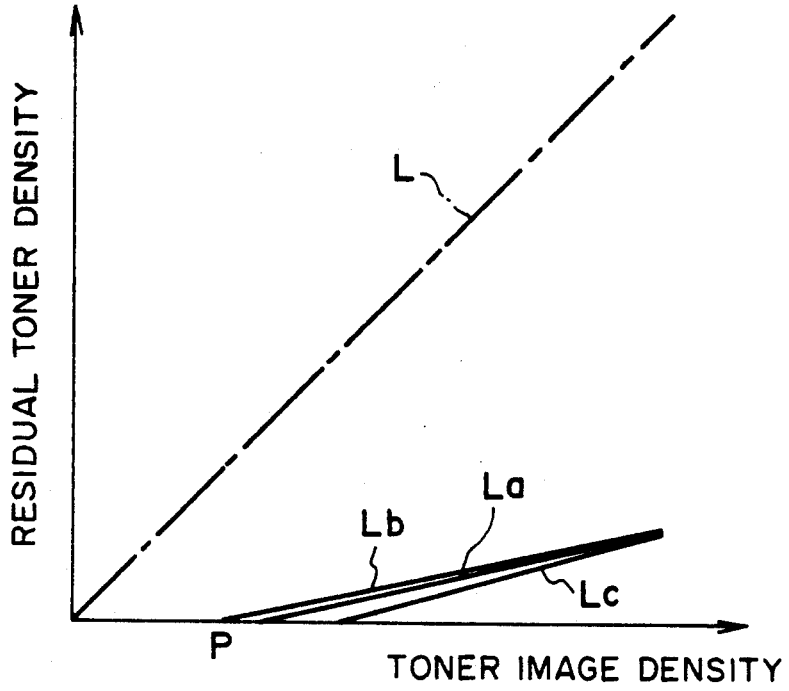
FIG. 5 is a graph of a residual toner density on a photosensitive drum after toner image transfer vs. toner image density before transfer with the parameter of toner charge amount, in the apparatus of FIG. 4.

FIG. 5 is a graph of the residual toner image density on the photosensitive drum vs. toner image density on the photosensitive drum before the image transfer. The toner image density was determined by detecting light reflected by the drum surface after the image transfer, when the toner charge amount before the image transfer is changed. The toner image before the transfer has the toner image density as indicated by a line L on the surface of the photosensitive drum 1. The toner image density is proportional to the image density of the image to be transferred onto the transfer sheet 14. In other words, the toner image density on the transfer sheet after the image transfer is proportional to the toner image density on the photosensitive drum before the image transfer.

On the graph of FIG. 5, lines La, Lb and Lc represent the toner density on the photosensitive drum 1 after the toner image having the density of line L is transferred. Where the toner image density is low, the transfer efficiency is substantially 100%, and therefore, the toner image density (residual toner image density) is 0, but with the increase of the toner image density, the amount of residual toner increases.

On the other hand, the line Lb indicates the residual toner density on the photosensitive drum when the toner charge amount of the toner image having the density indicated by the line L before the transfer, is high. The toner charge amount decreases in the order of Lb, La and Lc. In the case of Lb, the mirror force between the toner and the drum surface is relatively high, and therefore, a point where the transfer efficiency is 100% (residual toner density is 0 (P)) is deviated to the low density side as compared with the case of line La. Where the density is high a larger number of layers of the toner are overlaid on the photosensitive drum 1, and therefore, the influence of the mirror force is relatively low. For this reason, the difference from the line La or Lc is not large.

Figure 6:
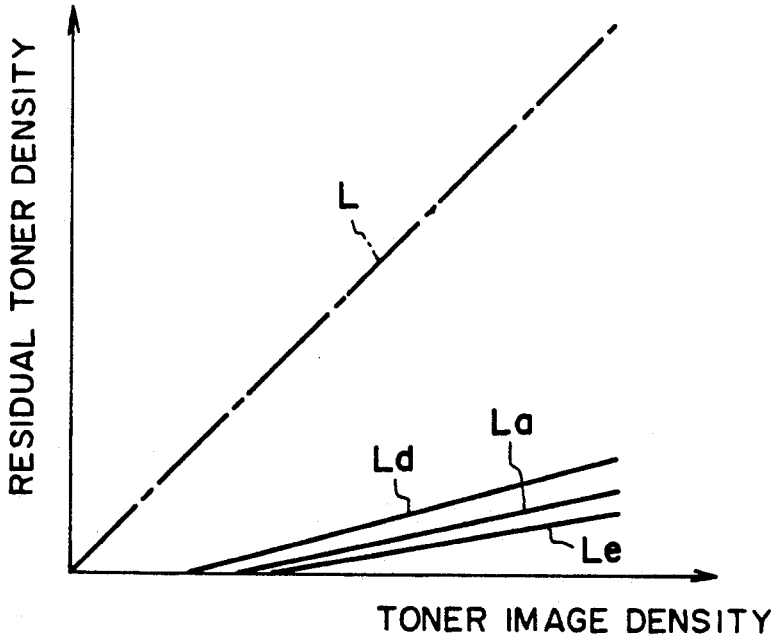
FIG. 6 is a similar diagram but with the parameter of the transfer electric field.

FIG. 6 shows a relationship between the residual toner image density on the photosensitive drum after the toner image transfer and the toner image density on the photosensitive drum surface before the image transfer with a parameter of the transfer electric field. A line Ld indicates the residual toner image density when the toner image having the density indicated by the line L is transferred with the transfer electric field which is lower than in the case of line La. As will be understood, when the transfer electric field is lowered, the transfer efficiency generally lowers with the result of the increase of the residual toner. A line La represents the residual toner density when the transfer electric field is higher than that of line La. As will be understood, the transfer efficiency is influenced by the toner charge amount before the toner image transfer and the transfer electric field during the transfer action, and the variation of the transfer efficiency is not uniform for the tone densities of the toner image. Therefore, production of a test image of single density on the photosensitive drum 1 and detection of transfer efficiency at the single density, alone, are not sufficient to discriminate whether the result of the detection is fed back to the toner charge amount or to the transfer electric field. This is the reason why the proper transfer condition control has been difficult.

Therefore, in this embodiment, when a toner image is formed on an image bearing member and is transferred onto a recording material by application of transfer electric field to provide an image on a recording material, an image transfer efficiency of a test image formed on an image bearing member and toner charge amount before transfer, are detected, and on the basis of the detections, the transfer operating condition for the toner image is properly controlled.

Figure 1:
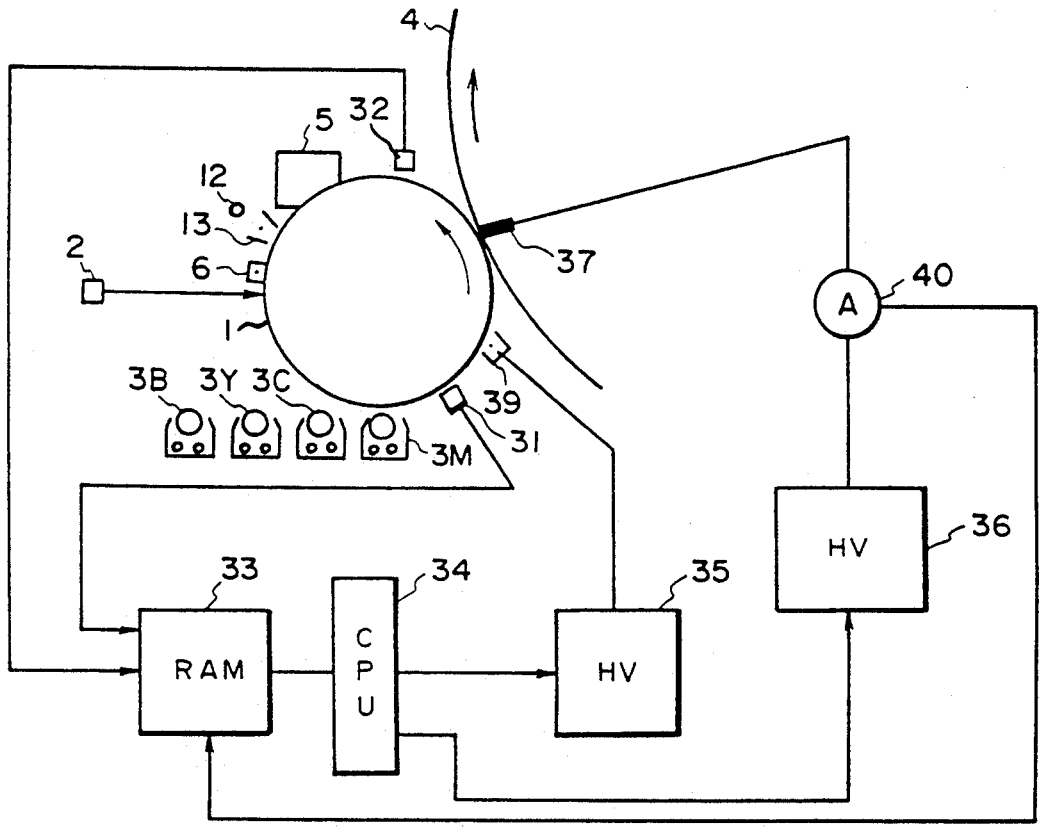
FIG. 1 is a schematic diagram of an image forming apparatus according to an embodiment of the present invention.

FIG. 1 is a schematic diagram of an image forming apparatus according to an embodiment of the present invention. In this embodiment, the image forming apparatus is provided with toner charge amount detecting means for detecting the charge amount of the toner of the toner image before the image transfer, a transfer efficiency detecting means and transfer condition controlling means.

As shown in FIG. 1, a transfer brush 37 is provided which is in contact with a back side of the transfer drum 4 at a position where it is faced to the photosensitive drum 1. The electric resistance of the brush 37 is properly adjusted. When the brush 37 is supplied with a voltage, an electric field is applied to the transfer material such as transfer sheet supported on the transfer drum 4, by which the toner image is transferred onto the transfer material from the photosensitive drum 1. In this embodiment, between the transfer brush 37 and a controllable constant high voltage source 36 for applying a voltage thereto an ammeter 40 constituting the toner charge amount detecting means is disposed. The transfer drum 4 comprises opposite rings, a connecting portion for connecting the rings and a dielectric sheet covering an opening defined by the rings and the connecting portion.

An optical sensor 31 is disposed along the outer surface of the photosensitive drum 1 between the developing device 3M and the transfer drum 4. An optical sensor 32 is disposed along the outer surface of the photosensitive drum 1 between the cleaner 5 and the transfer drum 4. The optical sensors 31 and 32 constitute the transfer efficiency detecting means for the toner image. The optical sensors 31 and 32 are connected to a RAM (random access memory) 33 for storing the results of detection, and the RAM 33 is connected to a CPU (central processing unit) 34.

A transfer pre-charger 39 is disposed along an outer surface of the photosensitive drum 1 between the optical sensor 31 and the transfer drum 4 to adjust the toner charge amount of the toner image on the photosensitive drum before the image transfer. The pre-charger 39 is connected to a high voltage source 35 which can controllably provide the constant voltage. According to this embodiment, the objects, i.e., the transfer conditions to be controlled by the transfer condition control means, are the toner charge amount before the toner image transfer and the transfer voltage applied to the brush 37 (transfer charging member) during the toner image transfer. By the connection between the CPU 34 and the high voltage source 35 connected with the transfer pre-charger 39 and between the CPU 34 and the high voltage source 36 connected with the transfer brush 37, the transfer condition control means for the toner image is constituted.

In the transfer condition control mode, the toner charge amount of the toner image before the transfer and the transfer electric field are controlled by the above structures. Firstly, a proper level signal is supplied to the light source (laser) 2, and a test patch latent image is formed on the photosensitive drum 1. It is developed into a toner test patch image on the photosensitive drum 1. A reflection image density A of the test patch toner image is detected by the optical sensor 31, and the detected density A is stored in the RAM 33. Subsequently, the test patch is transferred onto the transfer drum 4, and the electric current flowing through the transfer brush 37 is detected by the ammeter 40. The charge quantity Q is stored in the RAM 33.

After the image transfer operation executed, a reflection density B of the test patch toner which is still remaining on the photosensitive drum 1, is detected by the optical sensor 32, and the density B is stored in the RAM 33. Then, the CPU 34 execute the following calculation:

$$R=Q/(A-B)$$

The toner density difference (A−B) represents the amount of the toner transferred from the photosensitive drum 1. In the case of the brush transfer, substantially 100% of the transfer current is used for the toner transfer under the condition of the constant voltage. The transfer current corresponds to the flow of electric charge due to the toner being transferred, and therefore, the total charge quantity Q into the brush 37 corresponds to the total charge quantity of the transferred toner, that is, the toner total charge quantity of the test patch before the image transfer. Therefore, the above defined R represents the toner charge quantity per unit weight of the toner of the test patch before the image transfer.

The optimum level of the charge amount of the toner per unit weight before the toner image transfer, is stored in the CPU 34 beforehand the above R is compared with the optimum level. If it is lower than the optimum level, the voltage of the transfer precharger 39 is increased to increase the toner charge amount before the transfer. On the other hand, if it is higher, the voltage is decreased to decrease the toner charge amount before the image transfer.

When the value R is the optimum level, the following calculation is effected:

$$T=(A-B)/A$$

The value T represent the transfer efficiency of the test patch image. When the transfer efficiency is too low despite the proper toner charge amount before the transfer, the voltage of the transfer high voltage source 36 is adjusted to provide the proper transfer electric field so as to provide the proper transfer efficiency for the toner image transfer.

As described in the foregoing, in this embodiment, the test patch is used. The detections are made to the toner charge amount before the transfer and to the transfer efficiency. On the basis of the detections, the toner charge amount before the transfer on the photosensitive drum 1 and the transfer electric field are controlled. Therefore, the transfer conditions, i.e., the toner charge amount before the transfer and the transfer electric field are controlled to the optimum, so that the good image transfer operation is accomplished.

The charge amount of the toner constituting the toner image before the image transfer, is detected by the ammeter connected to the brush (transfer charge member) to detect the toner charge amount, and therefore, there is no need of using a particular detecting member around the photosensitive drum, and therefore, the structure of the apparatus is simplified.

Figure 2:
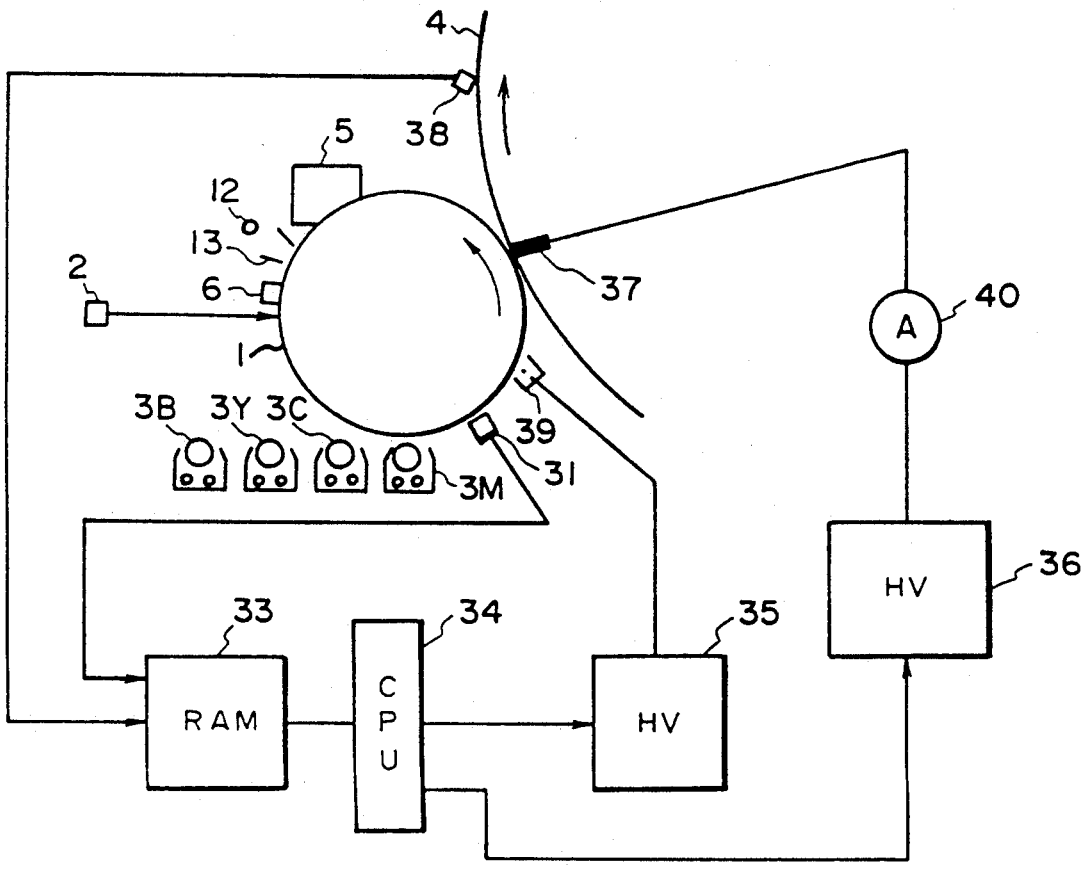
FIG. 2 is a schematic diagram of an image forming apparatus according to another embodiment of the present invention.

FIG. 2 is a schematic diagram of an image forming apparatus according to another embodiment. In this embodiment, the optical sensor 32 along the photosensitive drum 1 between the cleaner 5 and the transfer drum 4 in FIG. 1 image forming apparatus, is replaced with an optical sensor 38 adjacent an outer surface of the transfer drum 4 downstream of the transfer brush 37 in the rotational direction of the transfer drum 4, as shown in FIG. 2.

In this embodiment, the optical sensor 38 detects a toner reflection image density C of the test patch transferred onto the transfer drum 4, and the density C is stored in the RAM 33. The toner density C represents the toner quantity of the test patch image transferred onto the transfer drum 4, and therefore, it represents the toner image density difference (A−B) in the foregoing embodiment.

The charge amount R per unit weight of the toner of the test patch image before the transfer is determined by R=Q/C, where Q is the quantity of the electric charge having flown into the transfer brush 37. Similarly to the foregoing embodiment, the comparison is made relative to the optimum level of the charge amount per unit weight of the toner image before the transfer, and the toner charge amount before the transfer of the toner image is controlled thereby. When the value R is at the optimum level, T=C/A is determined, and on the basis of the determination, the transfer electric field during the toner image transfer action is controlled. Similarly to the foregoing embodiment, the toner image transfer conditions are controlled to the optimum, and therefore, the satisfactory image can be produced.

Figure 3:
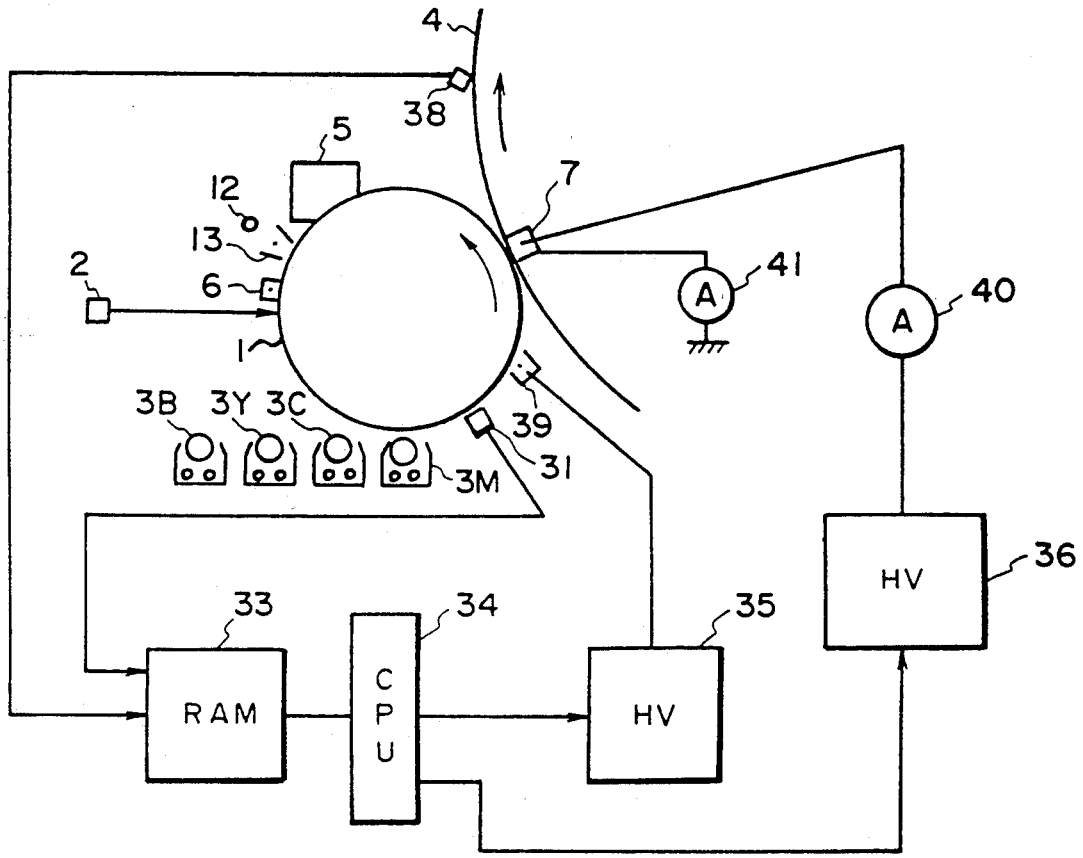
FIG. 3 is a schematic diagram of an image forming apparatus according to a further embodiment of the present invention.

FIG. 3 shows a further embodiment. In this embodiment, the transfer brush 37 for the toner image transfer in FIG. 2 image forming apparatus, is replaced with a transfer charger 7 having a corona charger comprising a wire electrode and a shield electrode. The transfer charger 7 is connected with an ammeter 41 for measuring electric current through the shield.

In this embodiment, a charge quantity Q is determined by measuring the electric current flowing into the wire of the transfer charger 7 by the ammeter 40. The electric current flowing into the shield of the transfer charger 7 is detected by the ammeter 41, and the charge quantity Qa is determined from the measured current. The difference $Qb=Q-Qa$, which is the charge quantity actually used for the transfer of the test patch image and therefore corresponds to the total current of the toner.

In place of Q in the embodiment of FIG. 2, the charge amount Qb is used, that is, the charge amount R per unit weight of the toner of the test patch image before the transfer is determined by R=Qb/C. Then, the toner charge amount before the transfer is controlled in the similar manner. When the value R is at the optimum level, T=C/A is determined in the same manner, and the transfer electric field is controlled on the basis of the determination. In the case of corona charger used for the toner image transfer, the similar effect can be provided.

In the foregoing embodiments, the toner charge amount or quantity before the toner image transfer is first controlled on the basis of the toner charge amount of the test patch image before the transfer, and when it is proper level, the transfer electric field during the transfer action is controlled on the basis of the transfer efficiency of the test patch. However, it is a possible alternative that the toner charge amount before the transfer and the transfer electric field are simultaneously controlled on the basis of the combination of the toner charge amount of the test patch image before the transfer and the transfer efficiency.

In the foregoing, the description has been made as to a full color image forming apparatus comprising one photosensitive drum 1, 4 developing devices 3M, 3C, 3Y and 3B and one transfer drum 4. However, the present invention is not limited to this example. For example, four photosensitive drums and developing devices 3M—3B for the respective photosensitive drums, and a common transfer belt is used in place of the transfer drum 4. If the same system as in FIG. 2 embodiment is used with this structure, the photosensitive drums are each provided with an optical sensor 31 for detecting the toner image density of the test patch image on the associated photosensitive drum 4. As for the detection of the toner density of the test patch image already transferred onto the transfer belt, one optical sensor may be provided downstream of the transfer position of each of the photosensitive drum, but the number of optical sensors 38 may be saved if only one such a sensor is provided at the most downstream position to detect the toner density of the test patch image.

The present invention is not limited to the case of the color image, but is similarly applicable to monochromatic image forming apparatuses. The applicable image forming apparatuses are not limitedly a digital exposure type using a laser beam. They may be an analog exposure type. In this case, a standard image having 16 tone levels may be provided in a non-image-forming region of an original supporting platen. An image thereof is formed through analog exposure, and the image is developed into a test patch image having 16 tone levels on the photosensitive drum 1.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

toner image forming means for forming a toner image on said image bearing member;

transfer charging means for transferring the toner image from said image bearing member onto a transfer material;

first detecting means for detecting toner charge amount before image transfer onto the transfer material;

second detecting means for detecting efficiency of the image transfer; and control means for controlling a condition of image transfer operation in accordance with outputs of said first and second detecting means.

2. An apparatus according to claim 1, wherein said control means controls at least one of the toner charge amount and an electric field for the image transfer in accordance with outputs of said first and second detecting means.

3. An apparatus according to claim 2, further comprising toner charging means for charging the toner image after formation of the toner image on said image bearing member and before the image transfer, and said control means controls the toner charge amount by the toner charging means.

4. An apparatus according to claim 1, wherein said first detecting means detects an electric current of said transfer charging means contributable to the image transfer.

5. An apparatus according to claim 1, further comprising a transfer material carrying member for carrying the transfer material, wherein the toner image on said image bearing member is transferred onto the transfer material carried on said transfer material carrying member.

6. An apparatus according to claim 4, further comprising a transfer material carrying member for carrying the transfer material, wherein the toner image on said image bearing member is transferred onto the transfer material carried on said transfer material carrying member.

7. An apparatus according to claim 6, wherein said transfer charging means is contactable to such a side of the transfer material carrying member as is remote from said image bearing member, and said first detecting means detects an electric current supplied to said transfer charging means.

8. An apparatus according to claim 7, wherein when said first detecting means detects the electric current, the transfer charging means is supplied with a constant voltage.

9. An apparatus according to claim 4, wherein said transfer charging means is in the form of a corona charging means having a wire electrode and a shield electrode, and wherein said first detecting means detects electric currents flowing to the wire electrode and the shield electrode.

10. An apparatus according to claim 1, wherein said second detecting means includes a first sensor for detecting a density of the toner image on said image bearing member before the image transfer and a second sensor for detecting density of residual toner on said image bearing member after the image transfer.

11. An apparatus according to claim 5, wherein the toner image can be transferred onto the transfer material carrying member, and wherein said second detecting means includes a first sensor for detecting a toner density on said image bearing member before the image transfer and a second sensor for detecting a toner density on the transfer material carrying member after the image transfer.

12. An apparatus, according to claim 5, wherein plural color toner images can be formed on said image bearing member, and the toner images are sequentially transferred and overlaid on the transfer material carried on the transfer material carrying member.

13. An apparatus according to claim 12, wherein said apparatus is capable of forming a full color image on the transfer material.

14. An image forming apparatus, comprising:

an image bearing member;

toner image forming means for forming a toner image on said image bearing member;

transfer charging means for transferring the toner image from said image bearing member onto a transfer material;

detecting means for detecting an electric current of said transfer charging means which is contributable to image transfer; and control means for controlling a toner charge amount before the image transfer in accordance with an output of said detecting means.

15. An apparatus according to claim 14, further comprising toner charging means for charging the toner image after formation of the toner image on said image bearing member and before the image transfer, and said control means controls the toner charge amount by the toner charging means.

16. An apparatus according to claim 14, further comprising a transfer material carrying member for carrying the transfer material wherein the toner image on said image bearing member is transferred onto the transfer material carried on said transfer material carrying member.

17. An apparatus according to claim 16, wherein said transfer charging means is contactable to such a side of the transfer material carrying member as is remote from said image bearing member, and said detecting means detects an electric current supplied to said transfer charging means.

18. An apparatus according to claim 17, wherein when said detecting means detects the electric currents, the transfer charging means is supplied with a constant voltage.

19. An apparatus according to claim 14, wherein said transfer charging means is in the form of a corona charging means having a wire electrode and a shield electrode, and wherein said detecting means detects electric currents flowing to the wire electrode and the shield electrode.

20. An apparatus according to claim 16, wherein plural color toner images can be formed on said image bearing member, and the toner images are sequentially transferred and overlaid on the transfer material carried on the transfer material carrying member.

21. An apparatus according to claim 20, wherein said apparatus is capable of forming a full color image on the transfer material.

* * * * *

UNITED STATES PATENT AND TRADEMARK OFFICE

CERTIFICATE OF CORRECTION

PATENT NO. : 5,296,903
DATED : March 22, 1994
INVENTOR(S) : AKIO SUZUKI, ET AL.

It is certified that error appears in the above-indentified patent and that said Letters Patent is hereby corrected as shown below:

Column 1,
Line 16, "as" should read --as a--.

Column 5,
Line 8, "execute" should read --executes--; and
Line 40, "represent" should read --represents--.

Column 9,
Line 5, "material" should read --material,--.

Signed and Sealed this

Thirtieth Day of August, 1994

*Attest:*

*Attesting Officer*

BRUCE LEHMAN

*Commissioner of Patents and Trademarks*